US009133800B2

(12) United States Patent
MacVicar et al.

(10) Patent No.: US 9,133,800 B2
(45) Date of Patent: Sep. 15, 2015

(54) FUEL QUILL PASSAGEWAY ASSEMBLY FOR ENGINE

(75) Inventors: Robert T. MacVicar, Downers Grove, IL (US); Brent Valesano, Des Plaines, IL (US); Frank J. Kalemba, Chicago, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 498 days.

(21) Appl. No.: 13/597,818

(22) Filed: Aug. 29, 2012

(65) Prior Publication Data

US 2013/0047962 A1 Feb. 28, 2013

Related U.S. Application Data

(60) Provisional application No. 61/529,179, filed on Aug. 30, 2011, provisional application No. 61/529,183, filed on Aug. 30, 2011, provisional application No. 61/529,185, filed on Aug. 30, 2011.

(51) Int. Cl.

| | |
|---|---|
| ***F02M 61/14*** | (2006.01) |
| ***F02M 55/00*** | (2006.01) |
| ***F02M 55/02*** | (2006.01) |
| *F02M 37/00* | (2006.01) |
| *F02M 69/46* | (2006.01) |

(52) U.S. Cl.

CPC ..... *F02M 61/14* (2013.01); *F02M 55/005* (2013.01); *F02M 55/02* (2013.01); *F02M 37/0017* (2013.01); *F02M 69/462* (2013.01)

(58) Field of Classification Search

CPC ..... F02M 37/0017; F02M 55/004; F02M 55/005; F02M 55/02; F02M 55/025; F02M 69/46; F02M 69/462; F02M 69/52; F02M 2200/16; F02M 2200/856

See application file for complete search history.

(56) References Cited

U.S. PATENT DOCUMENTS

| | | | | |
|---|---|---|---|---|
| 4,860,700 | A | 8/1989 | Smith | |
| 5,365,907 | A | 11/1994 | Dietrich et al. | |
| 6,237,571 | B1 * | 5/2001 | Harrison | 123/469 |
| 7,086,357 | B2 | 8/2006 | Mac Vicar et al. | |
| 2011/0174272 | A1 * | 7/2011 | Male | 123/469 |
| 2012/0120834 | A1 * | 5/2012 | Sugar et al. | 370/252 |

* cited by examiner

*Primary Examiner* — Erick Solis
*Assistant Examiner* — Anthony L Bacon
(74) *Attorney, Agent, or Firm* — Finnegan, Henderson, Farabow, Garrett & Dunner, LLP

(57) ABSTRACT

A fuel quill passageway assembly for an engine is disclosed. The engine includes a head pot; a cylinder head having an outer wall situated adjacent to the head pot, an inner wall, and a water jacket situated between the outer wall and the inner wall; and a fuel injector situated adjacent to the inner wall. The assembly may include a first sleeve extending through an aperture in the head pot toward an aperture in the outer wall of the cylinder head. The assembly may also include a second sleeve extending from the aperture in the outer wall of the cylinder head, through the water jacket, to an aperture in the inner wall of the cylinder head. Additionally, the assembly may include a seal joining the second sleeve to the first sleeve.

20 Claims, 2 Drawing Sheets

FUEL QUILL PASSAGEWAY ASSEMBLY FOR ENGINE

CROSS-REFERENCE TO RELATED APPLICATIONS

This application claims the benefit of U.S. Provisional Patent Application No. 61/529,179, filed Aug. 30, 2011; U.S. Provisional Patent Application No. 61/529,183, filed Aug. 30, 2011; and U.S. Provisional Patent Application No. 61/529,185, filed Aug. 30, 2011, all of which are hereby incorporated by reference in their entireties.

TECHNICAL FIELD

The present disclosure relates generally to engines and, more particularly, to fuel quill passageway assemblies for engines.

BACKGROUND

Engines such as, for example, two-stroke diesel engines are used in variety of applications. In some applications, it is desirable to equip the engines with common rail fuel injection systems, which may help reduce emissions. In such systems, a pump provides pressurized fuel to all fuel injectors of an engine using a common rail, which can be connected to each of the fuel injectors via respective fuel quills.

U.S. Pat. No. 5,365,907 to Dietrich et al. ("the '907 patent") discloses a cylinder head for an internal combustion engine. The cylinder head includes a cylindrical recess, which accommodates a pressure tube. The '907 patent discloses that the pressure tube carries fuel from an injection pipe, connected to an injection pump, to a nozzle holder with a fuel injection nozzle (i.e., a fuel injector).

Although the '907 patent discloses that a cylindrical recess of a cylinder head can be used to facilitate the carriage of fuel from a pump through the cylinder head to an injector, certain disadvantages may persist. For example, in some applications, including the cylindrical recess in a cylinder head may undesirably restrict coolant flow through a water jacket of the cylinder head. Additionally, in some applications (e.g., retrofit applications), it may not be possible to cost effectively produce a cylinder head with the cylindrical recess.

The assemblies and engines of the present disclosure may help address the foregoing problems.

SUMMARY

One disclosed embodiment relates to a fuel quill passageway assembly for an engine including a head pot; a cylinder head having an outer wall situated adjacent to the head pot, an inner wall, and a water jacket situated between the outer wall and the inner wall; and a fuel injector situated adjacent to the inner wall. The assembly may include a first sleeve extending through an aperture in the head pot toward an aperture in the outer wall of the cylinder head. The assembly may also include a second sleeve extending from the aperture in the outer wall of the cylinder head, through the water jacket, to an aperture in the inner wall of the cylinder head. Additionally, the assembly may include a seal joining the second sleeve to the first sleeve.

Another embodiment relates to an engine. The engine may include a head pot. The engine may also include a cylinder head having an outer wall situated adjacent to the head pot, an inner wall, and a water jacket situated between the outer wall and the inner wall. Additionally, the engine may include a fuel injector situated adjacent to the inner wall. The engine may also include a first sleeve extending through an aperture in the head pot toward an aperture in the outer wall of the cylinder head. In addition, the engine may include a second sleeve extending from the aperture in the outer wall of the cylinder head, through the water jacket, to an aperture in the inner wall of the cylinder head. Additionally, the engine may include a seal joining the second sleeve to the first sleeve.

DETAILED DESCRIPTION

Figure 1:
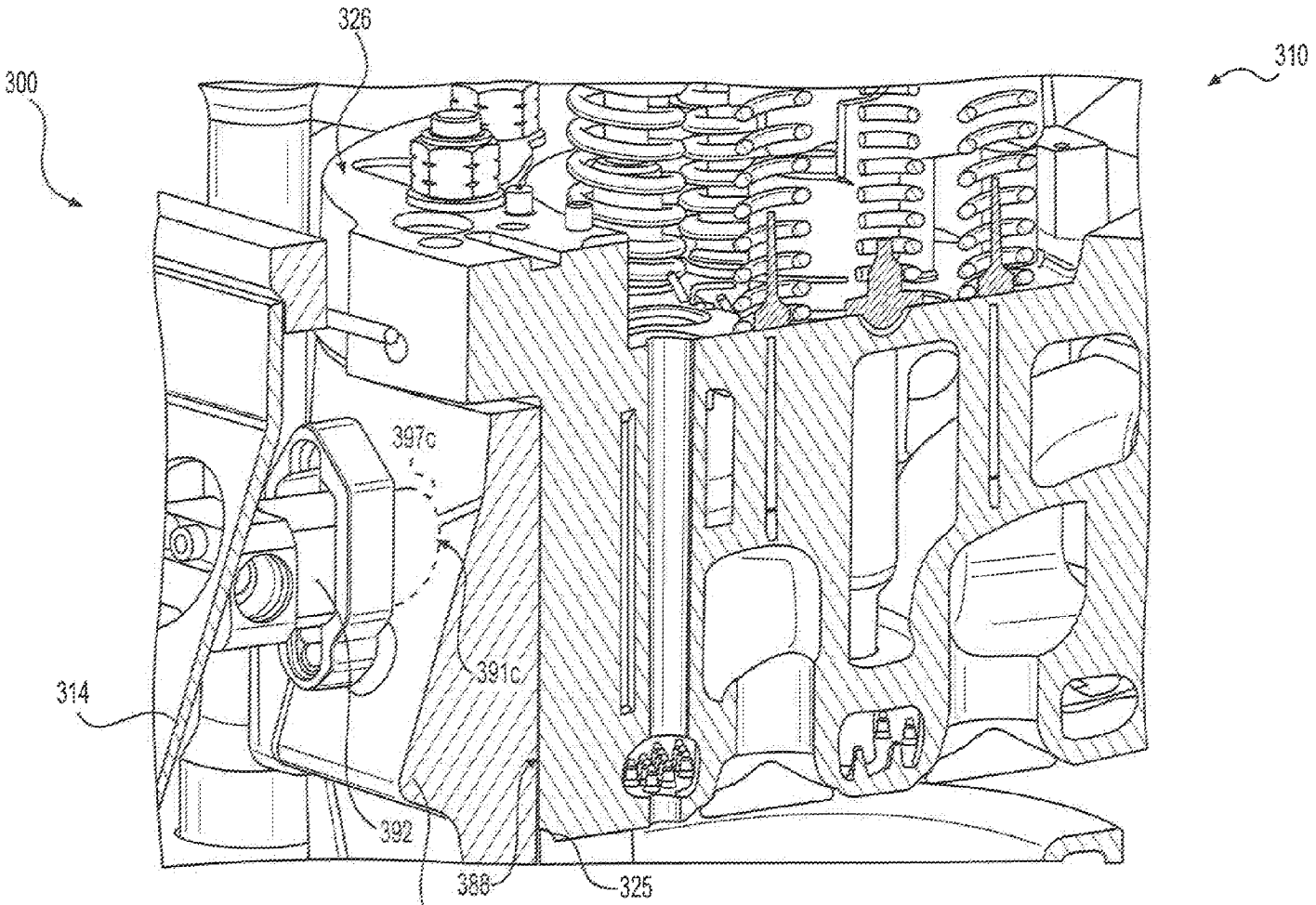
FIG. 1 is a cross-sectional view of an exemplary engine for use with a common rail fuel injection system.

FIG. 1 illustrates an engine 300 for use with a common rail fuel injection system. Engine 300 may be any type of engine configured to produce power by combusting fuel. For example, engine 300 may be a two- or four-stroke diesel, gasoline, or gaseous fuel powered engine. Regardless of type, engine 300 may include a crankcase 314 housing a crankshaft (not shown) powered by fuel combustion within one or more power assemblies 310.

Each power assembly 310 may be mounted on a head pot 398 (a welded feature of crankcase 314), and may include a liner 325 within which fuel is combusted using air received from an airbox (not shown). Power assembly 310 may also include a cylinder head 326 situated above liner 325 to close liner 325. In addition, power assembly 310 may include a fuel injector 387 (referring to FIG. 2) and a fuel quill 392 for supplying fuel from a common rail of the fuel injection system (not shown) to fuel injector 387.

Figure 2:
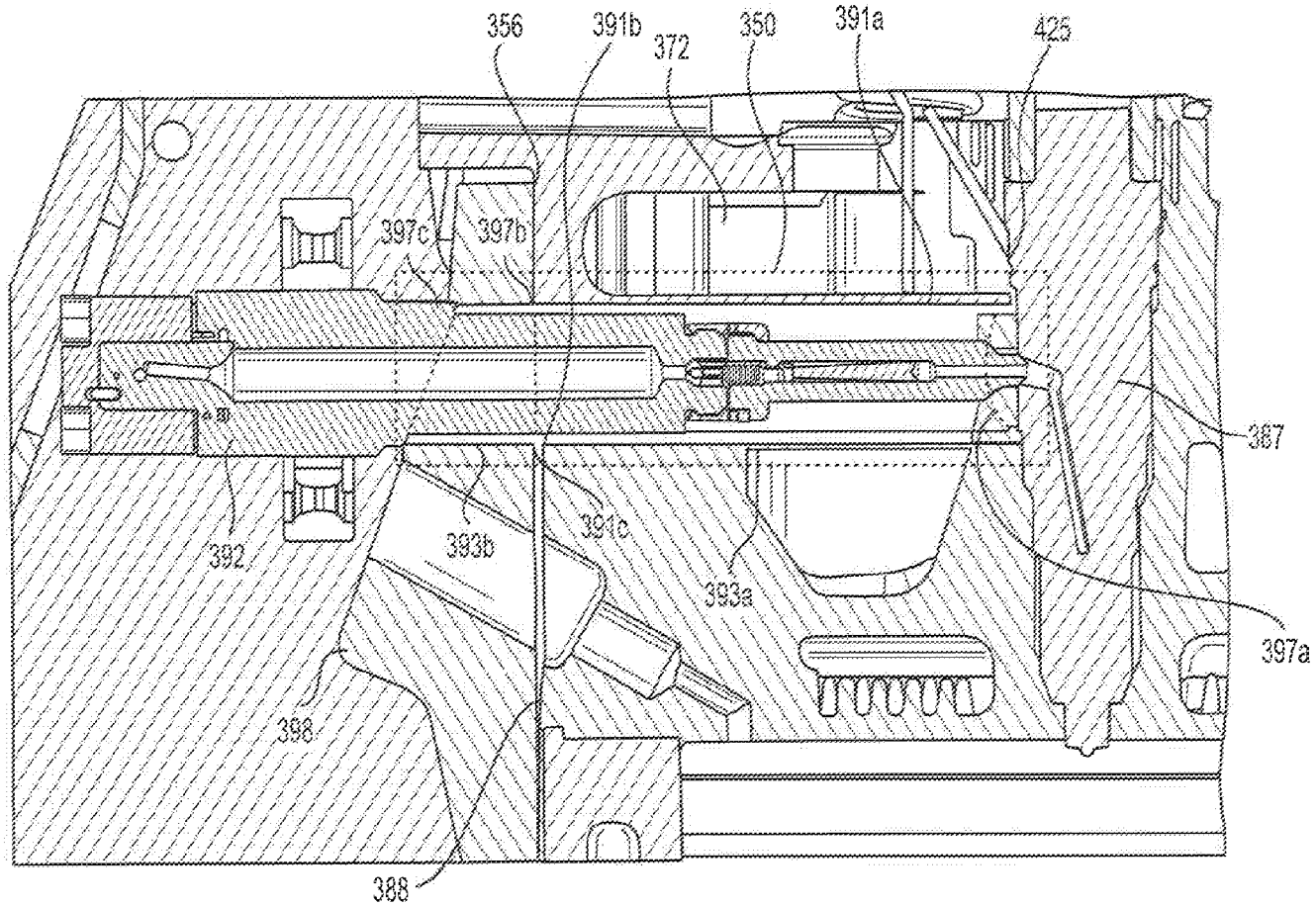
FIG. 2 is another cross-sectional view of the engine of FIG. 1.

As shown in FIG. 2, in order to connect the common rail to fuel injector 387, fuel quill 392 may pass through an aperture 391*c* in head pot 398, an aperture 391*b* in an outer wall 356 of cylinder head 326 (situated adjacent to head pot 398), and an aperture 391*a* in an inner wall 425 of cylinder head 326 (situated adjacent to fuel injector 387). In addition, fuel quill 392 may pass through a water jacket 372 of cylinder head 326 situated between outer wall 356 and inner wall 425. It is contemplated that fuel quill 392's passage through all of these parts of power assembly 310 may result in undesirable leakages of various fluids and/or gasses. For example, coolant from water jacket 372 might leak via apertures 391*a-c* into liner 325 (referring to FIG. 1), crankcase 314 (referring to FIG. 1), or the airbox (via a clearance 388 between head pot 398 and cylinder head 326 that is in communication with the airbox). Additionally, pressurized air from the airbox and/or exhaust gas remnants in clearance 388 might leak via apertures 391*a-c* into liner 325, crankcase 314, or water jacket 372. Accordingly, in order to prevent the leakages, power assembly 310 may also include a fuel quill passageway assembly 350 that isolates coolant in water jacket 372 and air and/or exhaust gas remnants in clearance 388 from each other and from other parts of engine 300.

Fuel quill passageway assembly 350 may include removable sleeves 393*a* and 393*b*, which may be formed from steel and adapted to receive fuel quill 392. As shown in FIG. 2, sleeve 393*b* may extend through aperture 391*c* in head pot 398 toward aperture 391*b* in outer wall 356 of cylinder head 326, and sleeve 393*a* may extend from aperture 391*b* in outer wall 356 of cylinder head 326, through water jacket 372, to aperture 391*a* in inner wall 425 of cylinder head 326.

Fuel quill passageway assembly 350 may also include various seals (e.g., seals 397*a-c*), which may be used to join sleeves 393*a* and 393*b* to each other and/or to other parts of power assembly 310. For example, seals 397*b* and/or 397*c* may join sleeve 393*b* to aperture 391*c* in head pot 398. Also, seal 397*b* may join sleeve 393*b* to sleeve 393*a* and/or join sleeve 393*a* to aperture 391*b* in outer wall 356 of cylinder head 326. In addition, seal 397*a* may join sleeve 393*a* to aperture 391*a* in inner wall 425 of cylinder head 326 and/or to fuel injector 387. It is contemplated that sleeves 393*a* and 393*b* in combination with seals 397*a-c* may isolate coolant in water jacket 372 and air and/or exhaust gas remnants in clearance 388 from each other and from other parts of engine 300.

INDUSTRIAL APPLICABILITY

The disclosed engines and assemblies may be used in stationary or non-stationary machines, and may be particularly beneficial when used in machines having limited engine space (e.g., locomotives). The engines and assemblies may facilitate the use of common rail fuel injection systems by, for example, enabling their use on existing machines without requiring cost prohibitive modifications (e.g., expansion of engine bays and/or recasting of engine parts).

For example, fuel quill passageway assembly 350 may allow fuel quill 392 to pass through head pot 398 and cylinder head 326, thereby allowing a common rail of the common rail fuel injection system to be positioned next to head pot 398. Such placement may allow the common rail to be positioned within (as opposed to above) crankcase 314 and under a top deck of engine 300, reducing the amount of additional space required for the common rail fuel injection system and keeping any potential leak path from reaching hot exhaust system components.

In addition, fuel quill passageway assembly 350 may allow for easy installation/removal of the common rail fuel injection system and/or other engine 300 components. For example, given the removable nature of sleeves 393*a* and 393*b*, it may be possible to separately install/remove cylinder head 326. Additionally, since sleeves 393*a* and 393*b* may, in combination with seals 397*a-c*, isolate coolant in water jacket 372 and air and/or exhaust gas remnants in clearance 388 from each other and from other parts of engine 300, it may be possible to easily adapt (e.g., by simple machining operations as opposed to recasting operations) an existing cylinder head 326 for use with the common rail fuel injection system. For example, apertures 391*a-c* could simply be machined into head pot 398 and cylinder head 326, and could be positioned such that sleeve 393*a*, which extends from aperture 391*b* to aperture 391*a*, does not undesirably restrict coolant flow through water jacket 372.

It will be apparent to those skilled in the art that various modifications and variations can be made in the disclosed assemblies and engines without departing from the scope of the disclosure. Other embodiments of the disclosed assemblies and engines will be apparent to those skilled in the art from consideration of the specification and practice of the assemblies and engines disclosed herein. It is intended that the specification and examples be considered as exemplary only, with a true scope of the disclosure being indicated by the following claims and their equivalents.

What is claimed is:

1. A fuel quill passageway assembly for an engine including a head pot; a cylinder head having an outer wall situated adjacent to the head pot, an inner wall, and a water jacket situated between the outer wall and the inner wall; and a fuel injector situated adjacent to the inner wall, the fuel quill passageway assembly comprising:

a first sleeve extending through an aperture in the head pot toward an aperture in the outer wall of the cylinder head;

a second sleeve extending from the aperture in the outer wall of the cylinder head, through the water jacket, to an aperture in the inner wall of the cylinder head; and a seal joining the second sleeve to the first sleeve.

2. The fuel quill passageway assembly of claim 1, wherein the seal also joins the second sleeve to the aperture in the outer wall of the cylinder head.

3. The fuel quill passageway assembly of claim 2, wherein the seal also joins the first sleeve to the aperture in the head pot.

4. The fuel quill passageway assembly of claim 1, wherein the seal also joins the first sleeve to the aperture in the head pot.

5. The fuel quill passageway assembly of claim 1, comprising a seal joining the second sleeve to the aperture in the outer wall of the cylinder head.

6. The fuel quill passageway assembly of claim 1, comprising a seal joining the first sleeve to the aperture in the head pot.

7. The fuel quill passageway assembly of claim 1, comprising a seal joining the second sleeve to the fuel injector.

8. The fuel quill passageway assembly of claim 7, wherein the seal joining the second sleeve to the fuel injector also joins the second sleeve to the aperture in the inner wall of the cylinder head.

9. The fuel quill passageway assembly of claim 1, comprising a seal joining the second sleeve to the aperture in the inner wall of the cylinder head.

10. The fuel quill passageway assembly of claim 1, comprising a seal joining the second sleeve to the aperture in the inner wall of the cylinder head and the fuel injector, wherein the seal joining the second sleeve to the first sleeve also (i) joins the second sleeve to the aperture in the outer wall of the cylinder head, and (ii) joins the first sleeve to the aperture in the head pot.

11. An engine comprising:

a head pot;

a cylinder head having an outer wall situated adjacent to the head pot, an inner wall, and a water jacket situated between the outer wall and the inner wall;

a fuel injector situated adjacent to the inner wall;

a first sleeve extending through an aperture in the head pot toward an aperture in the outer wall of the cylinder head;

a second sleeve extending from the aperture in the outer wall of the cylinder head, through the water jacket, to an aperture in the inner wall of the cylinder head; and a seal joining the second sleeve to the first sleeve.

12. The engine of claim 11, wherein the seal also joins the second sleeve to the aperture in the outer wall of the cylinder head.

13. The engine of claim 12, wherein the seal also joins the first sleeve to the aperture in the head pot.

14. The engine of claim 11, wherein the seal also joins the first sleeve to the aperture in the head pot.

15. The engine of claim 11, comprising a seal joining the second sleeve to the aperture in the outer wall of the cylinder head.

16. The engine of claim 11, comprising a seal joining the first sleeve to the aperture in the head pot.

17. The engine of claim 11, comprising a seal joining the second sleeve to the fuel injector.

18. The engine of claim 17, wherein the seal joining the second sleeve to the fuel injector also joins the second sleeve to the aperture in the inner wall of the cylinder head.

19. The engine of claim 11, comprising a seal joining the second sleeve to the aperture in the inner wall of the cylinder head.

20. The engine of claim 11, comprising a seal joining the second sleeve to the aperture in the inner wall of the cylinder head and the fuel injector, wherein the seal joining the second sleeve to the first sleeve also (i) joins the second sleeve to the aperture in the outer wall of the cylinder head, and (ii) joins the first sleeve to the aperture in the head pot.

* * * * *